US008871029B1

(12) United States Patent
Leslie

(10) Patent No.: US 8,871,029 B1
(45) Date of Patent: Oct. 28, 2014

(54) SHOE CLEANING DEVICE AND METHOD

(71) Applicant: Peter W. Leslie, Ormond Beach, FL (US)

(72) Inventor: Peter W. Leslie, Ormond Beach, FL (US)

( * ) Notice: Subject to any disclaimer, the term of this patent is extended or adjusted under 35 U.S.C. 154(b) by 0 days.

(21) Appl. No.: 14/220,228

(22) Filed: Mar. 20, 2014

Related U.S. Application Data

(63) Continuation-in-part of application No. 13/564,471, filed on Aug. 1, 2012, now Pat. No. 8,715,422.

(60) Provisional application No. 61/589,630, filed on Jan. 23, 2012.

(51) Int. Cl.
*A47L 23/04* (2006.01)
*A47L 23/28* (2006.01)
*A47L 23/10* (2006.01)

(52) U.S. Cl.
CPC *A47L 23/28* (2013.01); *A47L 23/10* (2013.01)
USPC ..... 134/6; 15/104.92; 15/257.01

(58) Field of Classification Search
USPC ..... 15/97.2, 104.92, 257.01; 134/6
See application file for complete search history.

(56) References Cited

U.S. PATENT DOCUMENTS

| | | | |
|---|---|---|---|
| 3,648,322 | A | 3/1972 | Meisner |
| 4,275,970 | A | 6/1981 | Morrison et al. |
| 2005/0071942 | A1 | 4/2005 | Akhtar |

*Primary Examiner* — Randall Chin

(74) *Attorney, Agent, or Firm* — H. John Rizvi; Gold & Rizvi P.A.

(57) ABSTRACT

A shoe cleaning device is disclosed, mainly comprising a scrubber member and an enclosure. The scrubber member is provided with a handle and retention members to which disinfecting sanitary wipes can be attached, so that a user holding the scrubber member by the handle can use the scrubber member and attached sanitary wipe to efficiently remove soil and contamination from a shoe without soaking the shoe. The enclosure that has an internal space for storing a plurality of sanitary wipes, and an upper separation platform on top of which there is a recess for storing the scrubber member. The enclosure further includes a lid that closes onto the scrubber member and conceals the scrubber member, except for, optionally, the scrubber member handle. The lid preferably closes in a sealed manner to guarantee that the plurality of wipes does not dry out over time.

20 Claims, 8 Drawing Sheets

SHOE CLEANING DEVICE AND METHOD

CROSS-REFERENCE TO RELATED APPLICATIONS

This Non-Provisional Patent Application claims the benefit of U.S. Non-Provisional patent application Ser. No. 13/564,471, filed on Aug. 1, 2012, now U.S. Pat. No. 8,715,422 which in turn claims the benefit of U.S. Provisional Patent Application Ser. No. 61/589,630, filed on Jan. 23, 2012, both of which are incorporated herein in their entirety.

FIELD OF THE INVENTION

The present invention relates to a shoe cleaning device and, in particular, to a shoe sole cleaning device that includes an enclosure and a handheld scrubber that can be stored inside the enclosure, the enclosure containing disposable sanitary wipes that can be attached to the handheld scrubber in order to clean and sanitize a shoe sole.

BACKGROUND OF THE INVENTION

People entering a home, place of worship, business or other enclosed space while wearing shoes often carry a wide diversity of substances adhered to their shoe soles. These substances are generally undesirable for different reasons. For instance, the substances can include harmful bacteria picked up in public places such as supermarkets, drug stores, public restrooms, hospitals, parking lots, streets, parks or the like, which can end up being passed onto the floor of the home, place of worship, business or other enclosed space and contaminate the enclosed space. In another example, the substances can include staining agents such as mud, oil, grease, ink or the like which can cause stains on rugs, carpets, tiles, on upholstered furniture and other applicable surfaces in the home or other enclosed space. In yet another example, slippery substances picked up on the streets and brought into a home or other enclosed space floor can cause people walking on the floor to slip and fall, with the risk of being severely injured.

In order to prevent the aforementioned inconveniences, many people require shoes to be removed before entering their homes or businesses. Moreover, it is a tradition of many cultures and communities to require shoe removal before entering a home or a place of worship, in order to maintain purity and cleanliness of such an intimate space. However, many cultures are not used to, nor prepared for, such a habit; for instance, in these cultures, people wishing to remove their shoes have to decide whether to leave their shoes outside, pile them in a corner inside the house, carry them inside and wash the soles in a sink, or throw the shoes in a washing machine every day. Understandably, none of these measures is very popular or convenient. In consequence, in many cultures people continue to walk into their homes, businesses or other enclosed spaces wearing stained or contaminated shoes, taking the aforementioned risks.

Various shoe sole cleaning devices have been developed over time to help people clean their shoe soles comfortably and efficiently, prior to entering an enclosed space or in other applicable circumstances. However, these cleaning and/or sanitizing solutions are still lacking in availability, ease of use, cost effectiveness, simplicity and true efficiency.

For instance, one known solution provides an athletic shoe cleaner in the form of a scraper brush that is carried on a person's footwear or wrist. The scraper brush is used by removing the device from the footwear or wrist and is subsequently used to scrape off and dislodge large particles or debris adhered to the sole. This known solution, while somewhat useful, presents significant drawbacks. In the first place, although the use of a brush is well known throughout history and is somewhat effective in removing contaminants from shoe soles, the scrubbing action requires vigorous physical effort by the user and frequently scatters the debris in all directions, thus causing dirtiness and contamination of the vicinity. In addition, scrubbing does not remove bacteria, chemicals and other contaminating agents that may be present on the sole.

Another known solution in the prior art is a shoe sole sanitizing device consisting of a tray having a reservoir containing a sanitizing solution, and a resilient perforated grate with scraping edges on the tray. The perforated grate is of a resiliency sufficient to be depressed beneath the upper surface of the solution when stepped on by a wearer. A drain is provided in the reservoir for removal of used solution and particles which collects in therein. In certain versions of the design, an automated fluid fill and drain system may be mounted within or on the tray. This known solution, while somewhat useful, presents significant drawbacks. In the first place, the device is generally large in size and requires a dedicated area for use. In addition, in the version where an automated fluid/fill drain device is employed, the device becomes exponentially more complex and expensive due to the plumbing-associated installation costs and due to having to meet the applicable regulatory requirements for disposal of the cleaning solution. An additional drawback is that the device saturates the sole of the shoe, and possibly the shoe upper, resulting in a soaked shoe that requires excessive drying time.

In yet another solution known in the art, a sole cleaning and drying box apparatus is provided mainly for removing the dark residue that clings to shoe and boot soles after walking and playing on some types of asphalt paving. This box apparatus can be used for various types and sizes of shoes, allowing people to clean and dry both soles in just a few minutes without having to remove their shoes. The device contains high pile, thick tufted carpet pieces on contiguous sturdy basis that serve as the cleaner and dryer elements, working well on a variety of sole indentations. Used with liquid cleaner and a little water, this arrangement allows fast, easy and effective cleaning of shoe and boot soles. A simple attachment to the box holds the lid up while the soles are being cleaned, then closes for better appearance and security. Despite being useful, this solution is not free of significant drawbacks. Mainly, this solution is a combination of the two previously described solutions, as suffers from the deficiencies of both. On one hand, the use of a brush or tufted material scatters debris over adjacent areas. On the other hand, the device is generally large and thus requires a substantial area to be dedicated to the use of the device; in addition, when used with a liquid cleaner and water, the device is likely to oversaturate the sole and possibly the shoe upper.

Accordingly, there remains a need in the art to provide a shoe cleaning system and method that overcomes at least one of the aforementioned drawbacks, and is yet convenient to use, and effective in sanitizing and removing contaminating agents from the shoe.

SUMMARY OF THE INVENTION

The present invention overcomes the deficiencies of the known art and the problems that remain unsolved by providing a shoe cleaning device that includes a handheld scrubber member provided with a handle and retention members to which disinfecting sanitary wipes can be attached, so that the scrubber member and the attached sanitary wipe efficiently remove soil and contamination from a shoe without soaking the shoe. The device further includes an enclosure that has an internal space for storing a plurality of sanitary wipes, and an upper separation platform, on top of which there is a recess for storing the scrubber member. The enclosure further includes a lid that closes onto the scrubber member and conceals the scrubber member, except for, optionally, the scrubber member handle. The lid preferably closes in a sealed manner to guarantee that the plurality of wipes does not dry out through time.

In accordance with one embodiment of the present invention, the invention consists of a shoe cleaning device comprising:

an enclosure having a housing and a lid movably coupled thereto, said housing having a bottom surface, an opposed upper surface, and at least one side wall extending between said bottom surface and said upper surface and configured such that said housing defines an internal space therein;

a separation platform adjacent said upper surface of said housing;

a scrubber member that includes a base member having upper and lower surfaces, said scrubber member having a handle coupled to said scrubber member upper surface;

at least one retention member arranged at said base member upper surface, wherein said retention member is configured to retain a sanitary wipe therein.

In a second aspect, the lid is pivotably coupled to the housing.

In another aspect, the shoe cleaning device further comprises at least one fastener to secure the lid to the housing in the closed position.

In another aspect, the lid is movable between an open position enabling access to said separation platform and a closed position blocking access to said separation platform.

In another aspect, the upper surface of said housing defines a recess extending downwardly toward said housing bottom surface, said separation platform being positioned in said recess.

In another aspect, the scrubber member base member includes a configuration that is complementary to a configuration of said housing recess such that said scrubber member is selectively received in said housing recess and supported on said separation platform.

In another aspect, said lid is movable between an open position enabling access to said separation platform and a closed position blocking access to said separation platform, and wherein said lid comprises an opening arranged to face the recess when the lid is arranged in said closed position, the handle of the scrubber member being configured to protrude outwardly through the lid opening when the scrubber member is received in said housing recess and the lid is arranged in said closed position.

In another aspect, the device comprises an open container removably arranged at the housing upper surface, said removable open container having a base and side walls, the housing recess being delimited between the side walls of the open container, and the housing separation platform being the base of said removable open container.

In another aspect, the removable open container is configured to adopt a removed position in which access is provided to the internal space, and a mounted position in which said open container base prevents access to the housing internal space.

In another aspect, the shoe cleaning device further comprises:

a plurality of disposable sanitary wipes positioned in said internal space of said housing, said plurality of wipes being interconnected and contiguous;

wherein the shoe cleaning device comprises an opening configured to receive and communicate a respective one of said plurality of wipes from inside said internal space to a position overlaying said separation platform outside of said internal space.

In another aspect, the opening is arranged on the housing upper surface.

In another aspect, the opening is arranged on the separation platform.

In another aspect, said plurality of wipes is formed as a roll of perforated contiguous sanitary cleaning wipes situated on said housing bottom surface in said housing internal space.

In another aspect, said enclosure includes a tear tab coupled to said upper surface of said housing, said tear tab being configured to separate a respective wipe from an adjacent wipe.

In another aspect, each of said plurality of wipes includes a perforated seam at which respective wipes may be selectively separated.

In another aspect, said lid is movable between an open position enabling access to said separation platform and a closed position blocking access to said separation platform, and wherein said enclosure is atmospherically sealed when said lid is at said closed position such that said plurality of wipes is substantially prevented from drying out.

In accordance with another embodiment of the present invention, the invention consists of a shoe cleaning device, comprising:

an enclosure having a housing and a lid movably coupled thereto, said housing having a bottom surface, an opposed upper surface, and at least one side wall extending between said bottom surface and said upper surface and configured such that said housing defines an internal space therein;

a separation platform adjacent said upper surface of said housing;

a scrubber member that includes a base member having upper and lower surfaces, said scrubber member having a handle coupled to said scrubber member upper surface;

at least one retention member arranged at said base member upper surface, wherein said retention member is configured to retain a sanitary wipe therein; wherein said upper surface of said housing defines a recess extending downwardly toward said housing bottom surface, said separation platform being positioned in said recess, and wherein said scrubber member base includes a configuration that is complementary to a configuration of said housing recess such that said scrubber member is selectively received in said housing recess and supported on said separation platform.

In accordance with yet another embodiment of the invention, the present invention consists of a method for cleaning shoes, comprising the steps of:

providing an enclosure having a housing and a lid movably coupled thereto, said housing having a bottom surface, an opposed upper surface, and at least one side wall extending between said bottom and upper surface and configured such that said housing defines an internal space therein, wherein said enclosure includes a separation platform adjacent said upper surface;

providing a scrubber member that includes a base member having upper and lower surfaces, said scrubber member having a handle coupled to said scrubber member upper surface;

providing a retention member arranged at said base member upper surface, wherein said retention member is configured to retain a sanitary wipe therein;

removing a sanitary wipe from said housing internal space and positioning said sanitary wipe at least partially atop said separation platform; and placing the scrubber member on top of said sanitary wipe;

wrapping the sanitary wipe upward and onto said scrubber member and pressing at least part of said sanitary wipe to fit into said retention member.

In a second aspect, the method further comprises the steps of:

placing the scrubber member at least partially inside a recess extending downwardly toward said housing bottom surface, said separation platform being arranged at the bottom of the recess;

moving the lid to a closed position in which the lid blocks access to the separation platform and to the scrubber member base member, and in which at least part of the scrubber member handle protrudes outwards from the enclosure through an opening comprised in the lid;

fastening the lid to the housing;

holding the device by the handle member protruding outwards from the enclosure.

In another aspect, the method further comprises the steps of:

removing the separation platform from the housing, to provide access to the internal space therein;

placing or removing a plurality of sanitary wipes in said internal space;

placing the separation platform on the housing, to conceal said internal space;

arranging a first wipe of said plurality of sanitary wipe to protrude outwardly from said internal space through an opening comprised in the housing.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Two different embodiments of the shoe cleaning system according to the invention will now be described with reference to FIGS. 1 through 5 and FIGS. 6 through 9, respectively.

Figure 1:
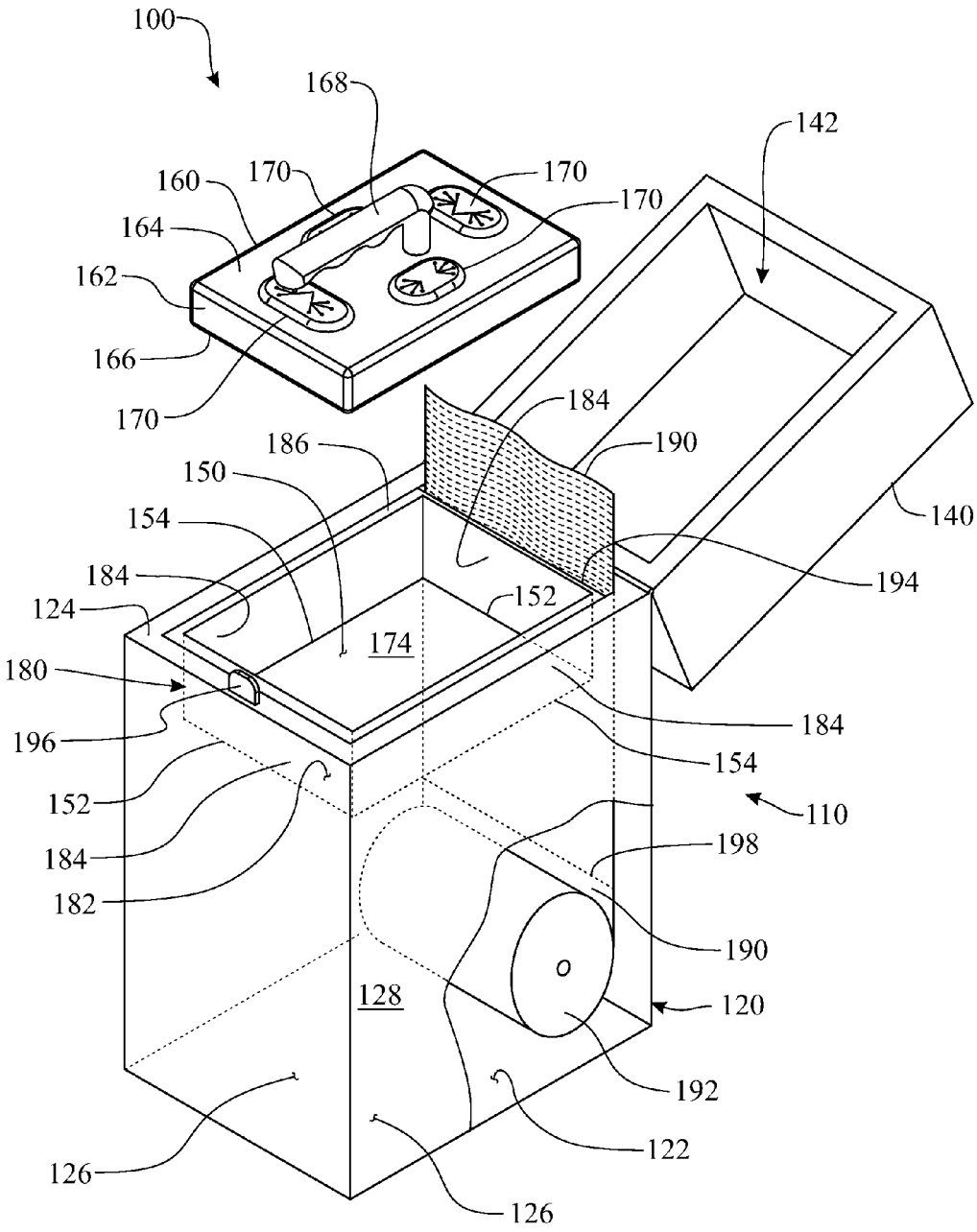
FIG. 1 presents a perspective view of a first embodiment of the shoe cleaning device in accordance with the invention, where the device is shaped as a rectangular prism, the device being shown in a first position in which the lid is arranged in an open position in relation to the housing, and the scrubber member is arranged outside the housing.

The illustration of FIG. 1 shows a first embodiment of a shoe cleaning device 100 in accordance with the invention. The shoe cleaning device 100 comprises an enclosure 110 which in turn includes a housing 120 and a lid 140. The lid 140 is movably coupled to the housing 120, so that the lid can be opened or closed to provide or prevent access to the elements beneath the lid, which will be explained. The housing 120 has a bottom surface 122, an opposed upper surface 124, and at least one side wall 126—four side walls 126, in the present embodiment—. The side walls 126 extend between bottom surface 122 and upper surface 124. The bottom surface 122 and side walls 126 are configured to define an internal space 128 within said housing 120. In addition, the shoe cleaning device 100 includes a separation platform 150 adjacent the upper surface 124 of the housing 120. In the embodiment shown, the separation platform 150 is a flat, rectangular surface that is perimetrally surrounded by the upper surface 124 in the event that the shoe cleaning device 100 is observed from a top, plan view, and that is arranged at a lower height than the upper surface 124.

The shoe cleaning device 100 further includes a handheld scrubber member 160, which is the main instrument to be used for cleaning a shoe, boot or other footwear, and in particular for cleaning their sole. The scrubber member 160 includes a base member 162 having an upper surface 164 and a lower surface 166. The scrubber member 160 further includes a handle 168 coupled to said base member upper surface 164. The lower surface 166 of the scrubber member provides a scrubbing surface with which to scrub a shoe or shoe sole. The lower surface can be fabricated from a sponge material, an applicator brush, a pliant scouring pad or combinations thereof. It is also contemplated that the entire base member 162 can be manufactured from a sponge material or other brushing or cleaning material.

The shoe cleaning device 100 further includes at least one retention member 170—four retention members 170, in the present embodiment—arranged at said base member upper surface 164. The retention members 170 are configured to retain a sanitary wipe therein. Preferably, the retention members 170 provide for releasable retention of the sanitary wipe such that a user may conveniently couple the wipe for use and then remove the soiled sanitary wipe after use, as will be explained. It is also preferred that the retention members 170 are elastic, and biased to grasp the wipe, so that the wipe is automatically grasped by the retention members 170 and thus a wipe can be easily and quickly attached to the scrubber member 160.

Preferably, the lid 140 is pivotably coupled to the housing 120, for instance by a barrel-hinged connection illustrated only schematically in the figure, but commonly known to a person skilled in the art. Alternative pivotable connections are envisaged, as understood by a person skilled in the art, and will not be described herein in order not to obscure the description of the invention. Having the lid 140 pivotably coupled to the housing 120 prevents the lid 140 from being lost or misplaced when open.

Figure 3:
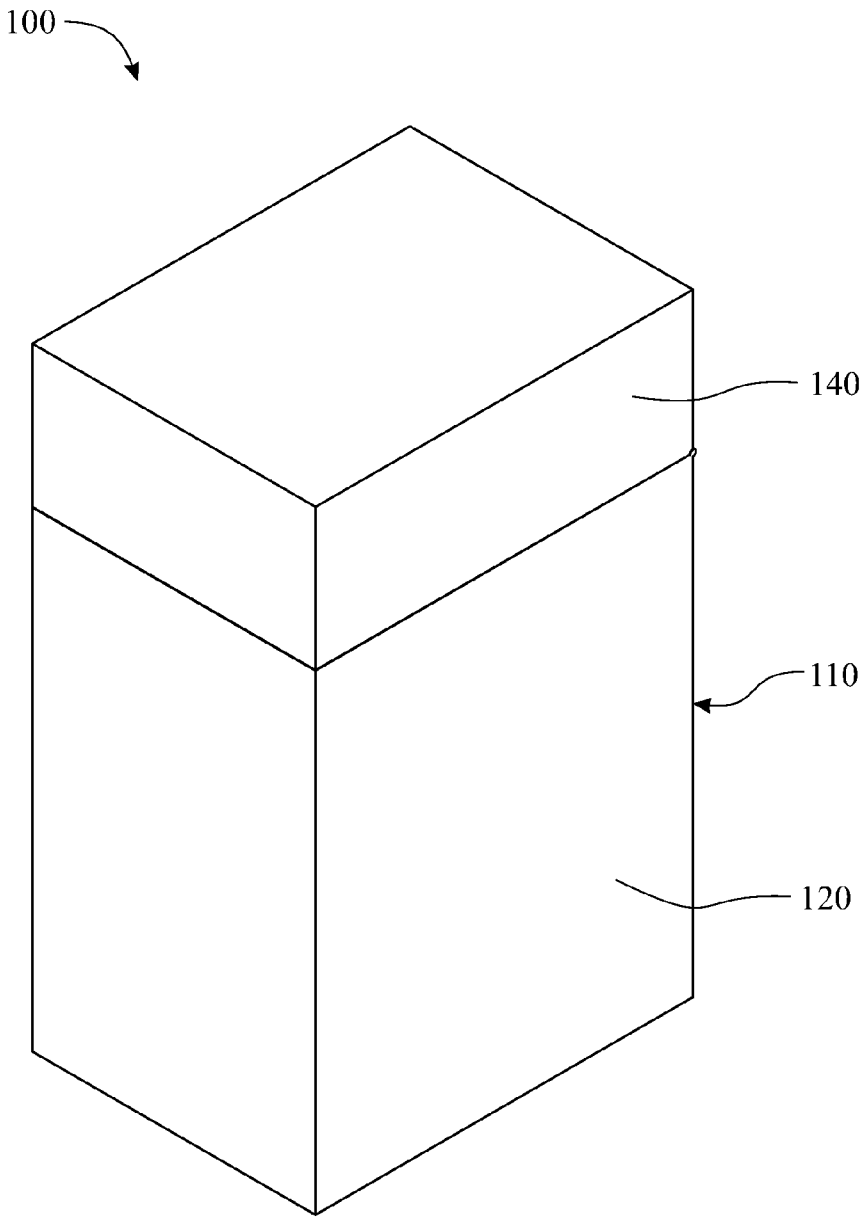
FIG. 3 presents the device of FIG. 1 in a third position, in which the lid is arranged in a closed position in relation to the housing, concealing the scrubber member.

The lid 140 is movable between an open position, as shown in FIG. 1, and a closed position, as shown in FIG. 3. In the open position. The lid 140 is separated from the housing upper surface 124, enabling access to the separation platform 150. In the closed position, instead, the lid 140 is placed on the housing 120, blocking access to said separation platform 150. As can be observed in FIG. 3, the shoe cleaning device 100 adopts a very sleek and clean appearance, as well as a very compact configuration, when the lid 140 is closed onto the housing 120.

Figure 2:
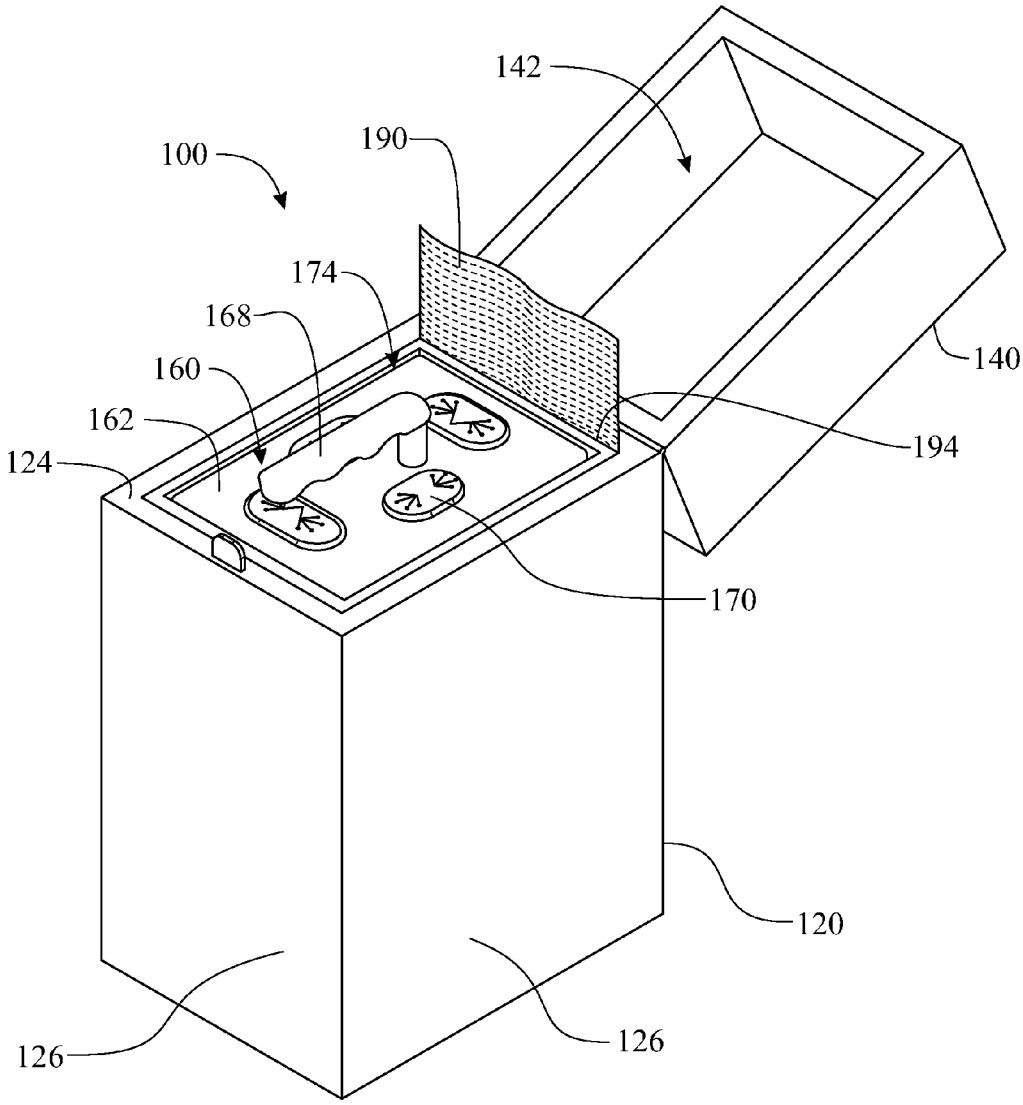
FIG. 2 presents the device of FIG. 1, shown in a second position, in which the scrubber member is inserted in a recess provided in the housing.

Turning again to FIG. 1, the housing upper surface 124 of the present embodiment defines a recess 174 extending downwardly toward the housing bottom surface 122. The separation platform 150 is positioned in said recess and, in particular, delimiting the recess 174 vertically in such a way that the separation platform 150 separates the recess 174 from the housing internal space 128. Having a recess 174 is convenient as it provides a storage space for shoe-cleaning-related items. In the present embodiment in particular, the housing recess 174 and the scrubber member base member 162 are configured in such a way that their shape and size is complementary. As shown in FIG. 2, such a configuration allows the scrubber member base member 162 to be selectively received in the housing recess 174 and to be supported on the separation platform 150. The scrubber member handle 168 protrudes outwardly, and the lid 140 comprises an inner space 142 for receiving the handle 168 when the lid 140 is in the closed position.

The illustration of FIG. 1 further shows that the shoe cleaning device 100 of the present embodiment includes an open container 180, particularly shaped as a rectangular vessel, comprising a base 182, side walls 184, and an upper flange 186 extending horizontally from the upper edge of the side walls 184. The open container 180 is removably arranged at the housing upper surface 124, preferably by having its upper flange 186 supported on the housing upper surface 124 while the side walls 184 and the base 182 are suspended inside the housing 120. The housing recess 174 is delimited between the side walls 184 of the open container 180. In turn, the housing separation platform 150 is provided by the base 182 of the removable open container 180. When the removable open container 180 is pulled out of its mounted position shown in FIG. 1, access is provided to the internal space 128 of the housing. When the open container 180 is placed back onto the housing upper surface 124, access to the internal space 128 is prevented.

In addition, the shoe cleaning device 100 of the present embodiment further includes a plurality of disposable sanitary wipes 190 positioned inside the housing, i.e., in the housing internal space 128. The plurality of wipes 190 is formed as a roll 192 of perforated contiguous sanitary cleaning wipes situated in the housing internal space 128, on the bottom surface 122. The wipes 190 are interconnected so that pulling of the terminal wipe 190 causes simultaneous pulling of the rest of wipes comprised in the plurality of wipes. An opening 194 is formed in the shoe cleaning device 100 to receive and communicate a respective one of said plurality of wipes—the terminal wipe 190 shown in FIG. 1—from internal space towards the outside. More specifically, the opening 194 is arranged to facilitate pulling of the terminal wipe to allow arranging a wipe 190 in a position overlaying the separation platform 150, as shown for instance in FIG. 4. The illustration shows the wipes 190 having been pulled out until the second wipe is arranged over the separation platform 150. Any given number of wipes can be pulled out, as will be understood by a person skilled in the art, the position of the opening 194 allowing for direct placement of one of the wipes over the separation platform 150.

In the present embodiment, the opening is arranged on the upper surface 124 of the housing 120. For example, the opening 194 can be formed as a gap between the upper surface 124 and the flange 186 of the open container 180. In another example, the opening 194 could be formed as a slot in the housing upper surface 124 itself. The opening 194 is arranged parallel to two transverse edges 152 of the rectangular separation platform 150 so that the wipe 190, when pulled, extends parallel to two opposing longitudinal edges 154 of the rectangular separation platform 150.

The sanitary wipes 190 are preferably fabricated from an absorbent material suitable for fluid saturation by a sanitizing/cleaning fluid or liquid. For instance, the sanitary wipes 190 can be a cloth made of cotton, polyester, nylon, paper, paper-composite or combinations thereof. Such wipes are well known and used in the household cleaning industry and are not described in detail so as not to obscure the invention herein.

Figure 4:
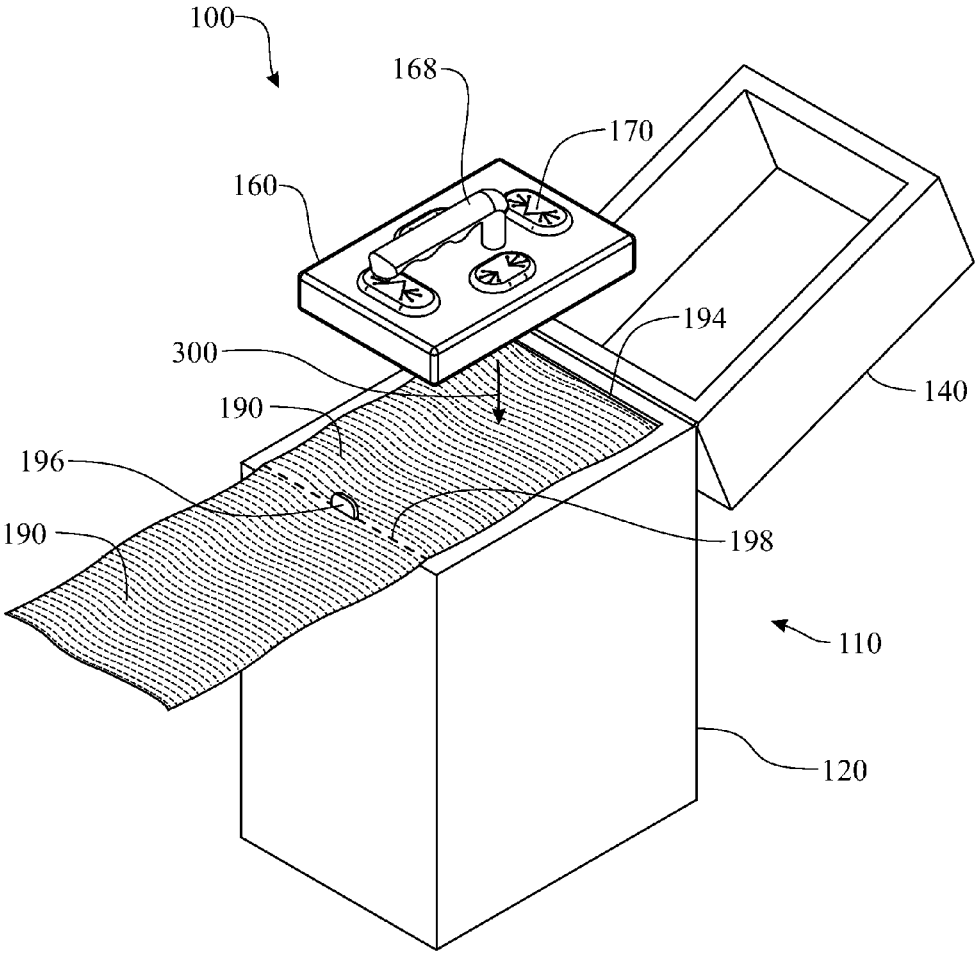
FIG. 4 presents the device of FIG. 1 in a fourth position, in which the lid is shown in the open position, two disinfectant sanitary wipes have been pulled out of the housing, and the scrubber member is about to be placed on a sanitary wipe.

The shoe cleaning device 100 preferably includes a tear tab 196 coupled to the upper surface 124 of the housing 120. The tear tab 196 is configured to separate two adjacent wipes 190, as shown in FIG. 4, by partially perforating a perforated, tearable seam 198 provided between the adjacent wipes 190 and providing a stop to the second wipe when a pulling force is exerted on the terminal wipe. The stop causes the pulling force to tear the terminal wipe from the second wipe.

The enclosure 110 formed by the housing 120 and the lid 140 is preferably atmospherically sealed when the lid 140 is at the closed position, so that the plurality of wipes is substantially atmospherically isolated and thus prevented from drying out when the shoe cleaning device 100 is not being used. Sealing can be achieved by placing elastomeric joints or seals along each mating edge between the housing 120 and the lid 140. In addition, the housing internal space 128 is preferably air-tight to further contribute to maintain moisture of the plurality of sanitary wipes 190.

Figure 5:
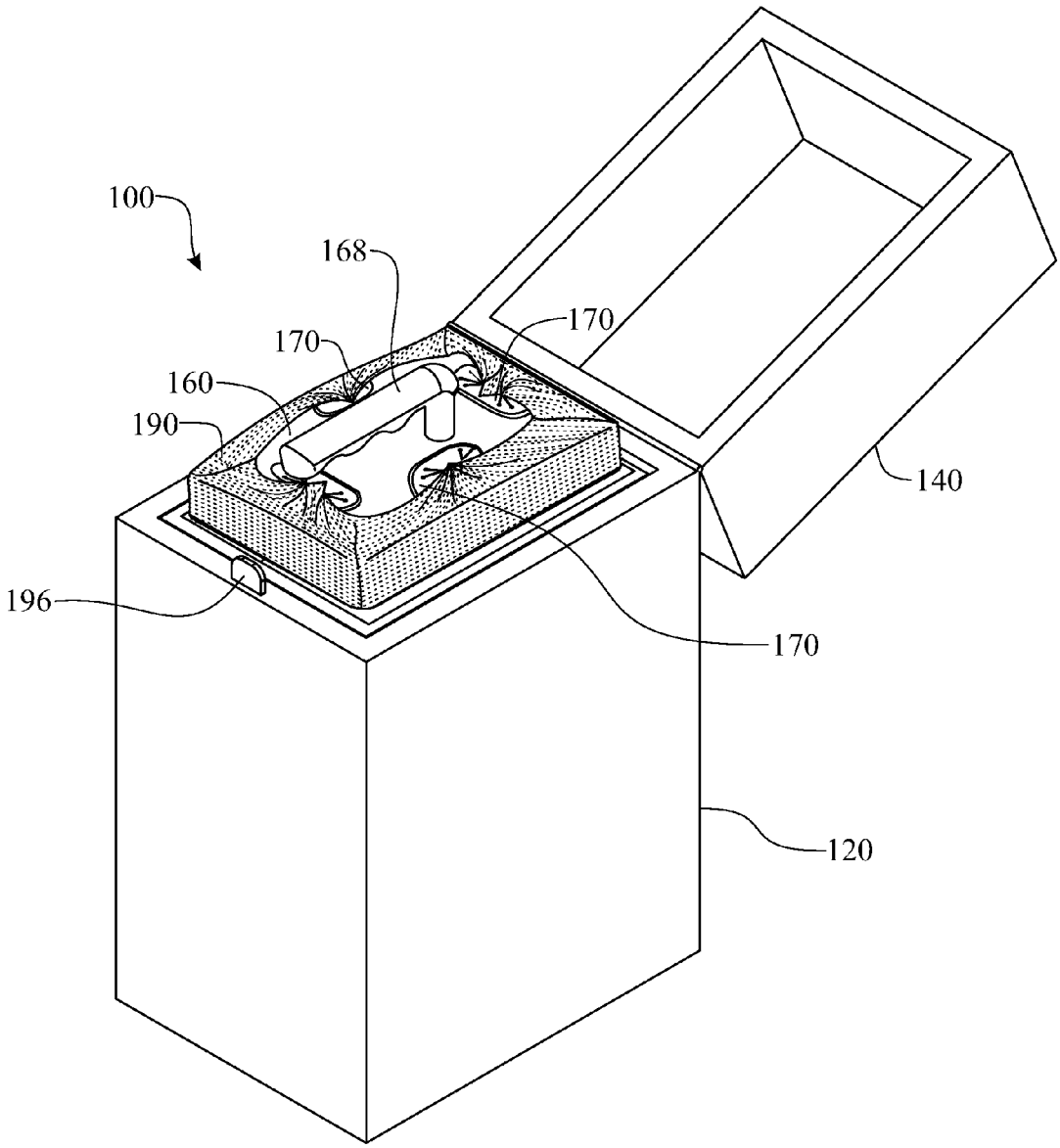
FIG. 5 presents the device of FIG. 1 in a fifth position, in which the scrubber member has been placed on the sanitary wipe and the wipe has been wrapped onto and secured to the scrubber member.

The illustrations of FIGS. 4 and 5 allow for better understanding of how the shoe cleaning device 100 is used for cleaning a shoe. Once the lid 140 is opened, a sanitary wipe 190 is removed from the housing internal space 128 and positioned at least partially atop the separation platform 150, as shown in FIG. 4. The illustration shows the second sanitary wipe 190 on top of the separation platform 150, but a person skilled in the art will understand that the first, third or other sanitary wipe 190 along the plurality of sanitary wipes could have been placed atop the separation platform 150 instead. Then, as indicated by arrow 300 in the figure, the scrubber member 160 is placed on top of the sanitary wipe 190 that is atop the separation platform 150. Once the scrubber member 160 contacts the sanitary wipe 190, the sanitary wipe 190 is wrapped upward and onto the scrubber member 160 as shown in FIG. 5, and portions of the sanitary wipe 190 are pressed to fit into the retention members 170. The sanitary wipe 190 is thus firmly attached to the scrubber member 160, and the scrubber member 160 is ready to be used for cleaning a shoe or shoe sole. Once the shoe has been cleaned, the sanitary wipe 190 is simply pulled off and disposed, and the scrubber member 160 is stored back in the recess 174.

The shoe cleaning device 100 can also be loaded or unloaded with sanitary wipes 190 as follows. The user removes the separation platform 150 from the housing 120—generally by removing the open container 180, the base of which provides the separation platform 150—, in order to provide access to the internal space 128 therein. The user then places or removes a plurality of sanitary wipes 190 in the internal space 128, and places the separation platform 150 back on the housing 120, to conceal the internal space 128, while simultaneously arranging a terminal or first wipe 190 of said plurality of sanitary wipe to protrude outwardly from said internal space 128 through the opening 194.

Figure 6:
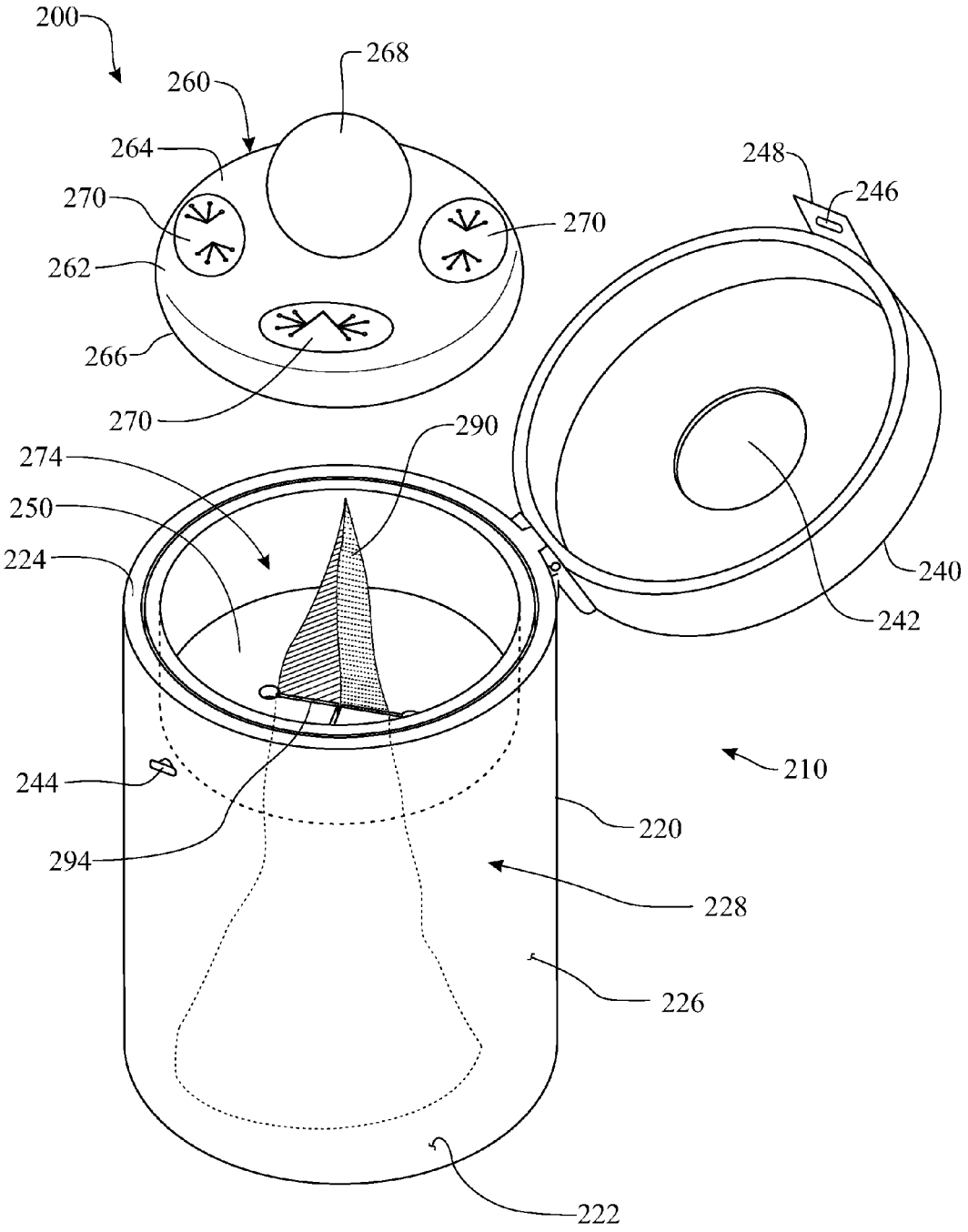
FIG. 6 presents a perspective view of a second embodiment of the shoe cleaning device in accordance with the invention, where the device is generally cylindrical in shape, the device being shown in a first position in which the lid is arranged in an open position in relation to the housing, and the scrubber member is arranged outside the housing.
Figure 7:
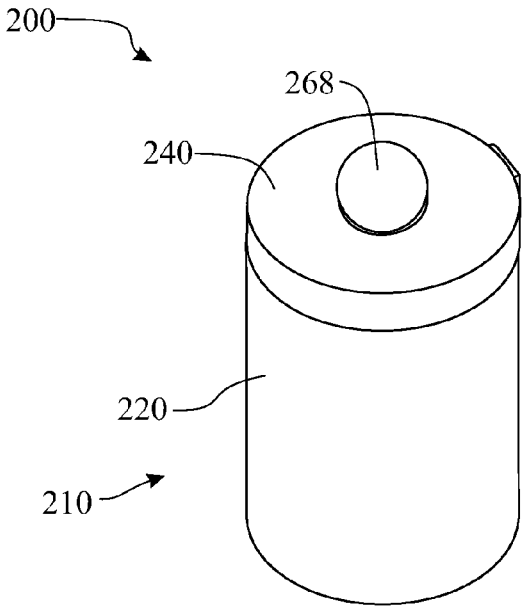
FIG. 7 presents the device of FIG. 6 in a second position, in which the lid is arranged in a closed position in relation to the housing, and the scrubber member handle protrudes outwards through an opening in the lid.

The illustration of FIG. 6 shows a second embodiment of the present invention, consisting in a shoe cleaning device 200 comprising an enclosure 210 that has a housing 220 and a lid 240, similarly to the first embodiment. The lid 240 is movably coupled to the housing 220. The housing 220 has a bottom surface 222, an opposed upper surface 224, and one side wall 226 extending between the bottom surface 222 and the upper surface 224. The bottom surface 222, upper surface 224 and side wall 226 are configured so that an internal space 228 is defined inside the housing 220. The shoe cleaning device 200 further includes a separation platform 250 adjacent the upper surface 224 of the housing 220. Similarly to the previous embodiment, a scrubber member 260 is provided, having a base member 262 and a handle 268. The base member 262 presents an upper surface 264, from which the handle 268 protrudes upwards, and a lower surface 266. In the present embodiment, the base member 262 is a round sponge, pliant scouring pad or other combination thereof and the handle 268 is a rigid sphere. The scrubber member 260 features four retention members 270—three of which are visible in the figure—arranged at the base member upper surface 264. Each retention member 270 is configured to retain a sanitary wipe therein, similarly to the previous embodiment. The housing upper surface 224 defines a recess 274 extending downwardly toward the housing bottom surface 222. The separation platform 250 is positioned in the recess 274. The scrubber member base member 262 is complementary to the housing recess 274 so that the scrubber member 260 can be selectively received in the housing recess 274 and supported on the separation platform 250. The lid 240 is movable between an open position enabling access to the separation platform 250, as shown in FIG. 6, and a closed position blocking access to the separation platform 250, as shown in FIG. 7.

Turning again to FIG. 6, the present embodiment is different from the previous embodiment in that the lid 240 further includes an opening 242 arranged to face the housing recess 274 when the lid 240 is arranged in the closed position. As shown in FIG. 7, the scrubber member handle 268 is configured to protrude outwardly through the lid opening 242 when the scrubber member 260 is received in the housing recess 274 and the lid 240 is arranged in the closed position. Such an arrangement of the handle 268 passing through the lid opening 242 not only provides a singular aesthetic finish, but also provides the scrubber member handle 268 with an additional functionality of serving as a user-gripping handle to hold the entire shoe cleaning device 200. This additional functionality is enhanced by having the shoe cleaning device 200 further include at least one fastener to secure the lid 240 to the housing 220 in the closed position. For instance, the present embodiment includes a rotatable T-shaped fastener 244 attached to the housing 220 and configured to engage with a matching slot 246 formed on a flap 248 of the lid 240. In alternative embodiments, the lid can be sealed with respect to housing by way of a releasable clasp, snap, buckle or other mechanical fastening means. Being able to secure the lid 240 to the housing 220 allows the user to safely hold and carry the shoe cleaning device 200 by gripping the scrubber member handle 268.

Figure 8:
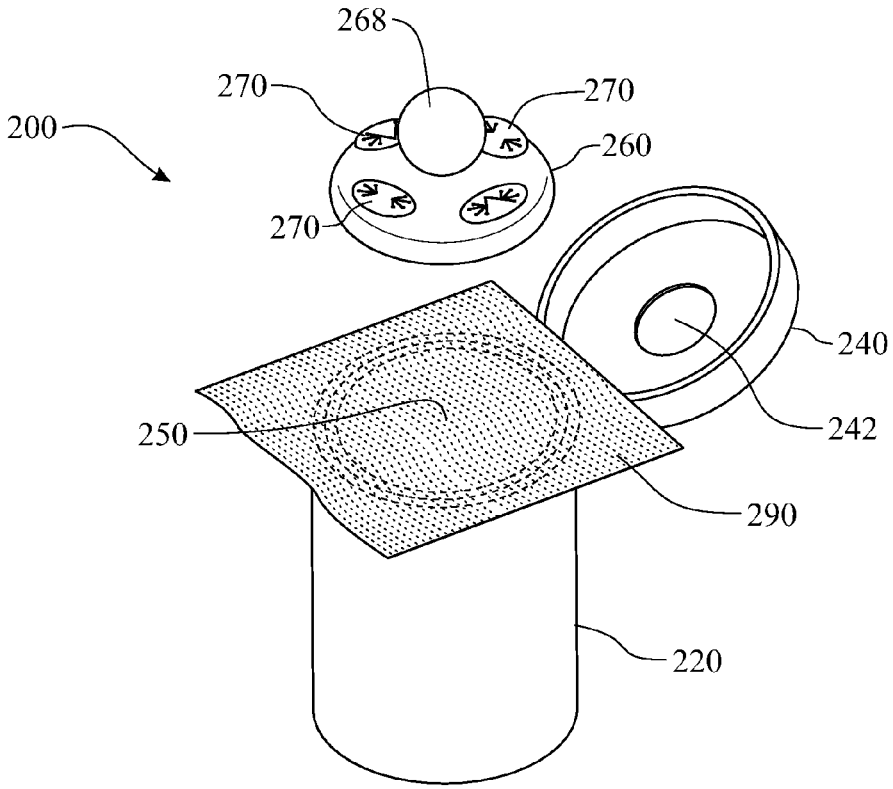
FIG. 8 presents the device of FIG. 6 in a third position, in which the lid is shown in the open position, a disinfectant sanitary wipe has been pulled out of the housing and placed on the housing, and the scrubber member is about to be placed on the sanitary wipe.
Figure 9:
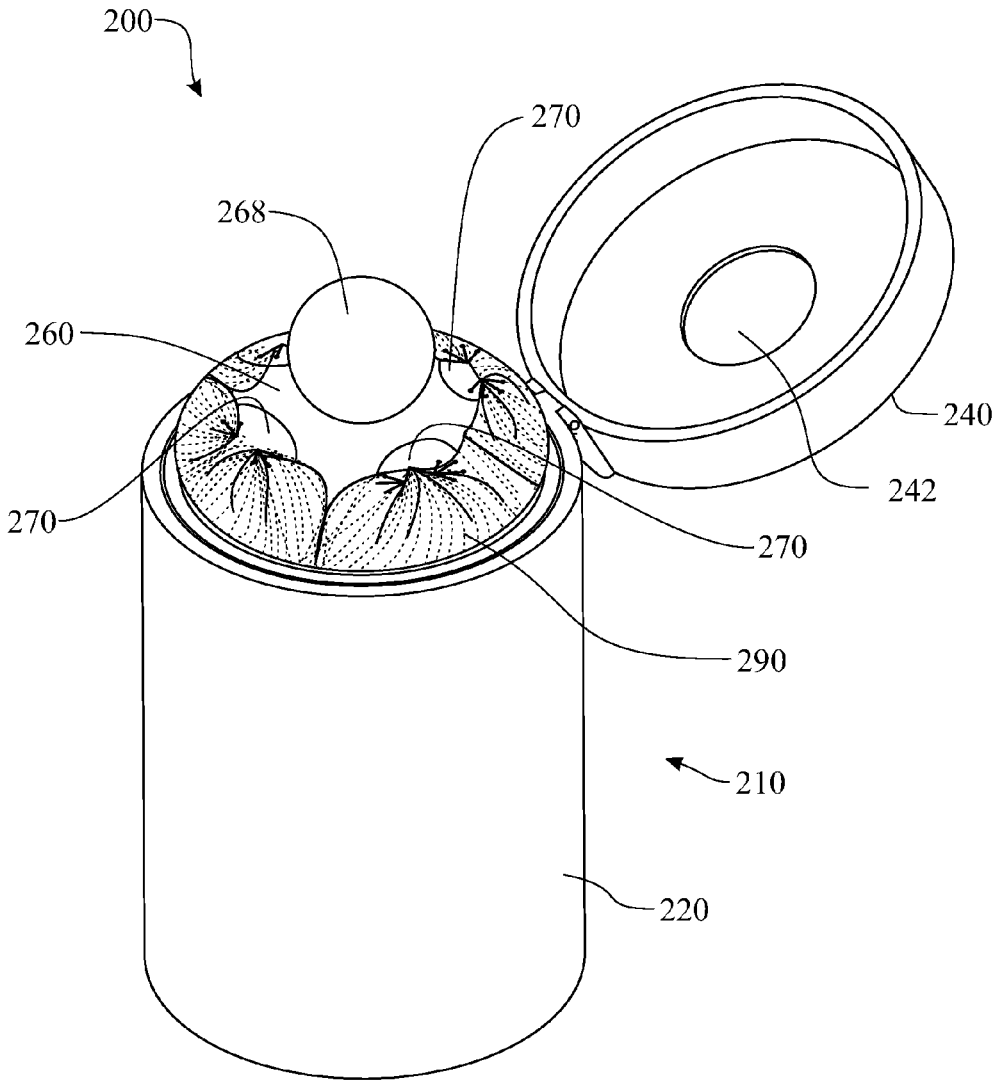
FIG. 9 presents the device of FIG. 6 in a fourth position, in which the scrubber member has been placed on the sanitary wipe and partially inside a recess of the housing, and the wipe has been wrapped onto and secured to the scrubber member.

In addition, similarly to the previous embodiment, the shoe cleaning device 200 of the present embodiment includes a plurality of interconnected, contiguous disposable sanitary wipes 290 positioned in the housing internal space 228. The shoe cleaning device 200 comprises an opening 294 configured to receive and communicate a respective one of said plurality of wipes from inside the internal space 228 and allow extracting said one wipe 290. The purpose of extracting the wipe 290 is normally to place the wipe 290 in a position overlaying the separation platform 250, as shown in FIG. 8, to be able to mount the scrubber member 260 on said wipe 290, to wrap the wipe 290 on the scrubber member 260 and to attach the wipe 290 to the retention members 270 as shown in FIG. 9. However, in the present embodiment, the opening 294 through which wipes 290 are extracted from the housing 220 is arranged on the separation platform 250, as shown in FIG. 6.

It is contemplated that the enclosure may be fabricated from various materials such as plastic, metal or other suitable material. The fabrication of the various elements and features of the enclosure may be performed by one or more well-known manufacturing processes that one of ordinary skill in the art would readily understand. These materials and processes are not described in detail so as not to obscure the teachings of the present invention. It is further contemplated that the enclosure may be fabricated in various textures, colors or shapes, or combinations thereof, as fashionably and functionally desired. For instance, although the two depicted exemplary embodiments respectively include a rectangular and a cylindrical enclosure and scrubber member, other shapes and proportions are possible and are contemplated by the inventor such that one of ordinary skill in the art would recognize suitable alternatives within the teachings of the present invention.

In alternative embodiments, it is also contemplated that the internal space contains sanitation wipes arranged in a different manner to that of FIG. 1. For instance, the internal space can contain several rolls of sanitary wipes, which can be either coupled to the housing to roll controllably, or can rotate freely within the internal space. In another example, the sanitary pads can be arranged as a stack of interconnected or overlapped wipes.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A shoe cleaning device, comprising:

an enclosure having a housing and a lid movably coupled thereto, said housing having a bottom surface, an opposed upper surface, and at least one side wall extending between said bottom surface and said upper surface and configured such that said housing defines an internal space therein;

a separation platform adjacent said upper surface of said housing;

a scrubber member that includes a base member having upper and lower surfaces, said scrubber member having a handle coupled to said scrubber member upper surface;

at least one retention member arranged at said base member upper surface, wherein said retention member is configured to retain a sanitary wipe therein.

2. The shoe cleaning device of claim 1, wherein the lid is pivotably coupled to the housing.

3. The shoe cleaning device of claim 1, further comprising at least one fastener to secure the lid to the housing in a closed position.

4. The shoe cleaning device of claim 1, wherein said lid is movable between an open position enabling access to said separation platform and a closed position blocking access to said separation platform.

5. The shoe cleaning device of claim 1, wherein said upper surface of said housing defines a recess extending downwardly toward said housing bottom surface, said separation platform being positioned in said recess.

6. The shoe cleaning device of claim 5, wherein said scrubber member base member includes a configuration that is complementary to a configuration of said housing recess such that said scrubber member is selectively received in said housing recess and supported on said separation platform.

7. The shoe cleaning device of claim 6, wherein said lid is movable between an open position enabling access to said separation platform and a closed position blocking access to said separation platform, and wherein said lid comprises an opening arranged to face the recess when the lid is arranged in said closed position, the handle of the scrubber member being configured to protrude outwardly through the lid opening when the scrubber member is received in said housing recess and the lid is arranged in said closed position.

8. The shoe cleaning device of claim 5, wherein the device comprises an open container removably arranged at the housing upper surface, said removable open container having a base and side walls, the housing recess being delimited between the side walls of the open container, and the housing separation platform being the base of said removable open container.

9. The shoe cleaning device of claim 8, wherein the removable open container is configured to adopt a removed position in which access is provided to the internal space, and a mounted position in which said open container base prevents access to the housing internal space.

10. The shoe cleaning device of claim 1, further comprising:

a plurality of disposable sanitary wipes positioned in said internal space of said housing, said plurality of wipes being interconnected and contiguous;

wherein the shoe cleaning device comprises an opening configured to receive and communicate a respective one of said plurality of wipes from inside said internal space to a position overlaying said separation platform outside of said internal space.

11. The shoe cleaning device of claim 10, wherein said opening is arranged on the housing upper surface.

12. The shoe cleaning device of claim 10, wherein said opening is arranged on the separation platform.

13. The shoe cleaning device of claim 10, wherein said plurality of wipes is formed as a roll of perforated contiguous sanitary cleaning wipes situated on said housing bottom surface in said housing internal space.

14. The shoe cleaning device of claim 13, wherein said enclosure includes a tear tab coupled to said upper surface of said housing, said tear tab being configured to separate a respective wipe from an adjacent wipe.

15. The shoe cleaning device of claim 13, wherein each of said plurality of wipes includes a perforated seam at which respective wipes may be selectively separated.

16. The shoe cleaning device of claim 13, wherein said lid is movable between an open position enabling access to said separation platform and a closed position blocking access to said separation platform, and wherein said enclosure is atmospherically sealed when said lid is at said closed position such that said plurality of wipes is substantially prevented from drying out.

17. A shoe cleaning device, comprising:

an enclosure having a housing and a lid movably coupled thereto, said housing having a bottom surface, an opposed upper surface, and at least one side wall extending between said bottom surface and said upper surface and configured such that said housing defines an internal space therein;

a separation platform adjacent said upper surface of said housing;

a scrubber member that includes a base member having upper and lower surfaces, said scrubber member having a handle coupled to said scrubber member upper surface;

at least one retention member arranged at said base member upper surface, wherein said retention member is configured to retain a sanitary wipe therein; wherein said upper surface of said housing defines a recess extending downwardly toward said housing bottom surface, said separation platform being positioned in said recess, and wherein said scrubber member base includes a configuration that is complementary to a configuration of said housing recess such that said scrubber member is selectively received in said housing recess and supported on said separation platform.

18. A method for cleaning shoes, comprising the steps of:

providing an enclosure having a housing and a lid movably coupled thereto, said housing having a bottom surface, an opposed upper surface, and at least one side wall extending between said bottom and upper surface and configured such that said housing defines an internal space therein, wherein said enclosure includes a separation platform adjacent said upper surface;

providing a scrubber member that includes a base member having upper and lower surfaces, said scrubber member having a handle coupled to said scrubber member upper surface;

providing a retention member arranged at said base member upper surface, wherein said retention member is configured to retain a sanitary wipe therein;

removing a sanitary wipe from said housing internal space and positioning said sanitary wipe at least partially atop said separation platform; and placing the scrubber member on top of said sanitary wipe;

wrapping the sanitary wipe upward and onto said scrubber member and pressing at least part of said sanitary wipe to fit into said retention member.

19. The method of claim 18, further comprising the steps of:

placing the scrubber member at least partially inside a recess extending downwardly toward said housing bottom surface, said separation platform being arranged at the bottom of the recess;

moving the lid to a closed position in which the lid blocks access to the separation platform and to the scrubber member base member, and in which at least part of the scrubber member handle protrudes outwards from the enclosure through an opening comprised in the lid;

fastening the lid to the housing;

holding the device by the handle member protruding outwards from the enclosure.

20. The method of claim 18, further comprising the steps of:

removing the separation platform from the housing, to provide access to the internal space therein;

placing or removing a plurality of sanitary wipes in said internal space;

placing the separation platform on the housing, to conceal said internal space;

arranging a first wipe of said plurality of sanitary wipe to protrude outwardly from said internal space through an opening comprised in the housing.

* * * * *